US006763648B2

(12) United States Patent
Sting et al.

(10) Patent No.: US 6,763,648 B2
(45) Date of Patent: Jul. 20, 2004

(54) DRIVE AND ACTUATING SYSTEM FOR AN ENVELOPE-FILLING STATION

(75) Inventors: Martin Sting, Bad Vilbel (DE); Christian Botschek, Rödermark (DE)

(73) Assignee: Pitney Bowes Deutschland GmbH (DE)

( * ) Notice: Subject to any disclaimer, the term of this patent is extended or adjusted under 35 U.S.C. 154(b) by 571 days.

(21) Appl. No.: 09/821,362

(22) Filed: Mar. 29, 2001

(65) Prior Publication Data

US 2003/0182899 A1 Oct. 2, 2003

(30) Foreign Application Priority Data

Mar. 29, 2000 (DE) ..... 100 15 754

(51) Int. Cl.[7] ..... B65B 61/20

(52) U.S. Cl. ..... 53/284.3; 53/469; 53/569; 53/237; 53/247; 53/381.3

(58) Field of Search ..... 53/469, 475, 569, 53/237, 247, 249, 250, 252, 284.3, 381.3, 381.5

(56) References Cited

U.S. PATENT DOCUMENTS

| | | | | | |
|---|---|---|---|---|---|
| 4,499,705 | A | * | 2/1985 | Russell | 53/284.3 |
| 4,527,378 | A | * | 7/1985 | Russell | 53/284.3 |
| 4,712,359 | A | * | 12/1987 | DePasquale et al. | 53/460 |
| 4,798,040 | A | * | 1/1989 | Haas et al. | 53/460 |
| 4,817,368 | A | * | 4/1989 | DePasquale et al. | 53/460 |
| 4,939,887 | A | | 7/1990 | Haas et al. | 53/460 |
| 5,457,941 | A | * | 10/1995 | Long et al. | 53/460 |
| 5,950,399 | A | * | 9/1999 | Viens et al. | 53/381.6 |
| 6,102,391 | A | * | 8/2000 | Malick et al. | 271/225 |
| 6,289,658 | B1 | * | 9/2001 | Sting et al. | 53/569 |
| 6,536,184 | B1 | * | 3/2003 | Sting et al. | 53/284.3 |

FOREIGN PATENT DOCUMENTS

| | | |
|---|---|---|
| DE | 19500746 A1 | 7/1996 |
| DE | 19830337 C1 | 11/1999 |
| GB | 374355 | 6/1932 |

* cited by examiner

*Primary Examiner*—Rinaldi I. Rada
*Assistant Examiner*—Hemant M. Desai
(74) *Attorney, Agent, or Firm*—Michael J. Cummings; Charles R. Malandra, Jr.; Angelo N. Chaclas

(57) ABSTRACT

A drive and actuating system for an envelope-filling station in which enclosures or sets of enclosures are fed, by a driven conveyor, to a push-in station in which a push-in arrangement, which has a pivot drive, receives the enclosures or sets of enclosures and pushes them into envelopes, which are held ready in an open state. The envelopes are then delivered into a position opposite the push-in station, from oriented transversely to the push-in direction, by an envelope-conveying arrangement. Further, a multiplicity of functions of the individual parts of the envelope-filling station can be forcibly synchronized in an adjustable manner and a comparatively straightforward and clear construction of the overall drive and actuating system is produced.

8 Claims, 3 Drawing Sheets

DRIVE AND ACTUATING SYSTEM FOR AN ENVELOPE-FILLING STATION

TECHNICAL FIELD

The invention relates to a drive and actuating system for an envelope-filling station in which enclosures or sets of enclosures are fed, by means of a driven conveyor, to a push-in station in which a push-in arrangement, which has a pivot drive, receives the enclosures or sets of enclosures and pushes them into envelopes, which are held ready in an open state, it being the case that the envelopes are delivered into a position opposite the push-in station, from a direction oriented transversely to the push-in direction, by means of an envelope-conveying arrangement.

RELATED ART

An envelope-filling station of this generally known construction is described, for example, in DE 195 00 746 A1. In such an envelope-filling station, individual functional groups such as enclosure conveyor, push-in station and envelope conveyor are also synchronised with one another.

This results, in some cases, in a complicated mechanical construction or in high outlay on electrical and electronic control and synchronisation means.

DE 198 30 377 C1 discloses a drive apparatus for a mail-processing machine in which, from a step-by-step motion linkage and a bevel gear mechanism driven by a common drive motor, via belt drives, both the continuously operated enclosure-conveying chain and an intermittently operated enclosure-conveying chain as well as a push-in arrangement and an intermittently operated envelope-conveying arrangement are driven and synchronism of the operating cycles of the functional groups is achieved.

SUMMARY OF THE INVENTION

The invention is intended to achieve the object of configuring a drive and actuating system for an envelope-filling station of the general type outlined in the introduction such that a multiplicity of functions of the individual parts of the envelope-filling station can be forcibly synchronised in an adjustable manner by straightforward means and a comparatively straightforward and clear construction of the overall drive and actuating system is produced.

This object is achieved according to the invention by a drive and actuating system having the features according to claim 1.

Advantageous configurations and developments of such a drive and actuating system are characterised in the patent claims subordinate to claim 1.

It can be seen that the drive and actuating system proposed here provides for the enclosures or sets of enclosures to be conveyed up continuously and then to be received cyclically by the push-in arrangement, which has a pivot drive, and to be pushed into the envelopes, which are likewise conveyed up cyclically, transversely to the push-in direction. Both the cyclic actuation of the push-in arrangement and the cyclic actuation of the envelope-conveying arrangement, and if appropriate also the cyclic actuation of an auxiliary push-in arrangement for keeping open the envelopes provided, are derived from the continuous drive for the conveyor which, for example on the top strand of a conveying chain, delivers the enclosures or sets of enclosures to the push-in station.

BRIEF DESCRIPTION OF THE DRAWINGS

An exemplary embodiment is explained in more detail hereinbelow with reference to the drawing. In the drawings, mutually corresponding parts have the same designations in each case and.

DETAILED DESCRIPTION OF THE INVENTION

Figure 1:
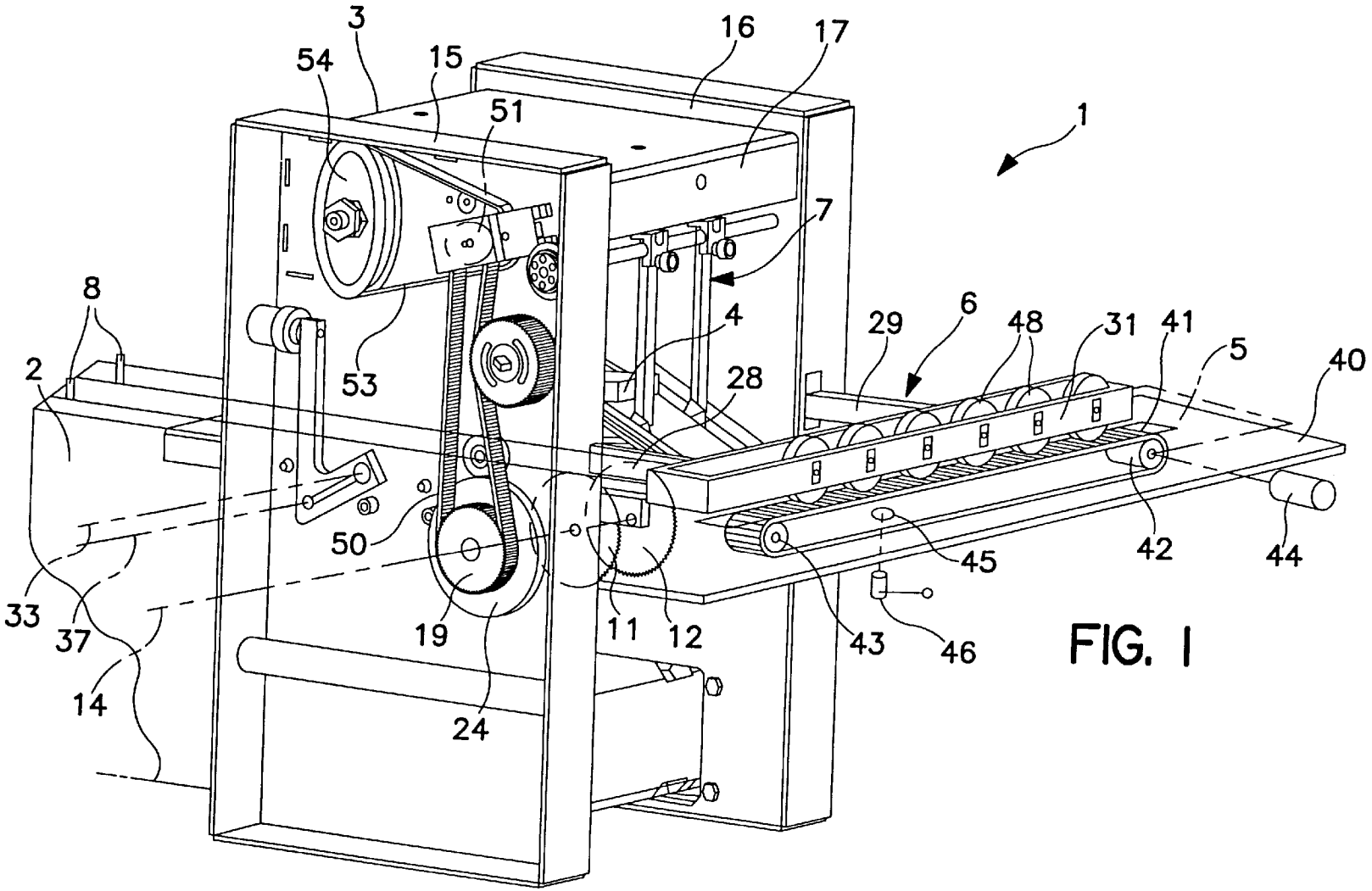
FIG. 1 shows a perspective, in part somewhat schematic view of an envelope-filling station with a drive and actuating system of the type specified here.

FIG. 1 shows an envelope-filling station 1 with a conveyor 2 for conveying enclosures or sets of enclosures up to a push-in station 3, in which a push-in arrangement 4, which is actuated by a pivot drive, grips the enclosures or sets of enclosures and pushes them into envelopes 5, which are held ready in an open state in a position opposite the push-in station 3. The envelopes 5 are delivered by means of an envelope-conveying arrangement 6 by movement of the envelopes 5 in a direction transverse to the push-in direction of the push-in arrangement 4.

Finally, the push-in station 3 contains an auxiliary push-in arrangement 7 which has the task of using fingers articulated on pivot arms to keep open a delivered envelope 5 opposite the push-in station 3, while push-in fingers of the push-in arrangement 4 grip the trailing borders of delivered enclosures or sets of enclosures and push the latter, beneath the fingers of the auxiliary push-in arrangement 7, into the envelopes 5.

In the exemplary embodiment shown, the conveyor 2 contains a conveying-chain arrangement which is equipped with conveying fingers 8 and is made up of two circulating chains 9 and 10 which are located one beside the other and are positioned over pairs of chain wheels, the respectively driven chain wheels being designated 11 and 12 in the drawing. In the region of the top strand of the conveying chains 9 and 10, the conveying fingers 8 project beyond the level of the top side of the conveyor 2, via slots of a conveying path, and define compartments there into which the enclosures or sets of enclosures are introduced and conveyed into the push-in station 3 as the conveying chains 9 and 10 circulate.

The driven chain wheels 11 and 12 of the conveying chains 9 and 10 are seated on a common drive shaft 13, of which the geometrical axis is designated 14. The shaft 13 is guided by bearings which are supported on side walls 15 and 16 of a gantry-like housing 17 of the push-in station 3.

On that side of the housing side walls 15 and 16 which is directed away from the interior of the housing 17, a toothed-belt pulley 18, on the one hand, and a further toothed-belt pulley 19, on the other hand, are seated in a rotationally fixed manner on the shaft 13. The toothed-belt pulley 18 serves for coupling the shaft 13, via a toothed belt 20 and a further toothed-belt pulley 21, to a drive motor 22 for the conveying chains 9 and 10, the toothed-belt pulley 21 being seated on the output shaft of said drive motor.

The toothed-belt pulley 19 serves for coupling the shaft 13 to a pivot drive for the push-in arrangement 4 and to drive means for the auxiliary push-in arrangement 7.

Figure 2:
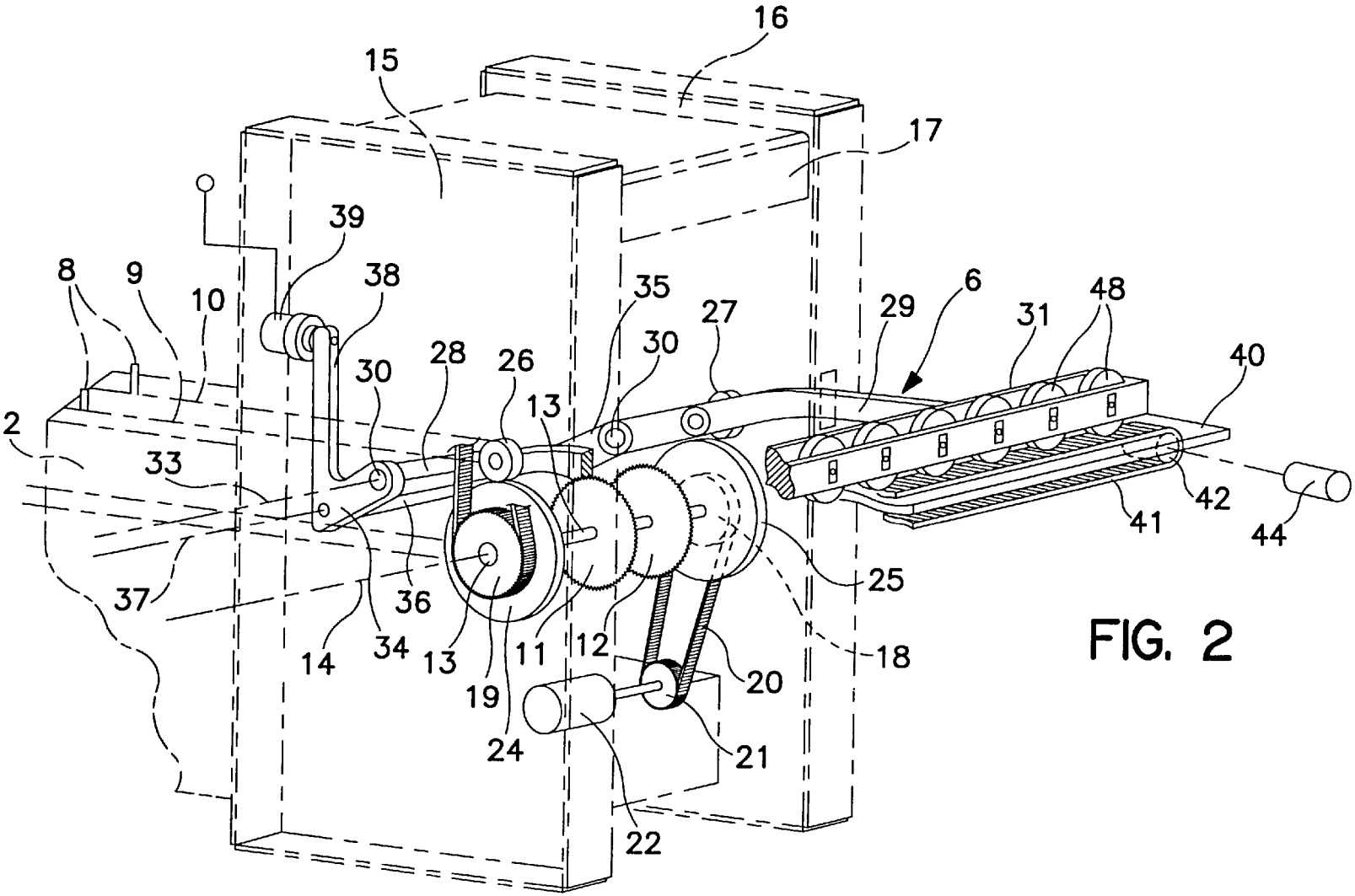
FIG. 2 shows a perspective view of the drive and actuating system relating to the envelope-conveying arrangement of the envelope-filling station according to FIG. 1.

First of all, however, the coupling of the drive for the conveying chains 9 and 10 to that part of the drive and actuating system which relates to the envelope-conveying arrangement 6 will be considered in more detail with reference to FIG. 2.

Between the side wall 15 of the push-in-station housing 17 and the toothed-belt pulley 19, a cam 24 is fastened on the shaft 13. Between the side wall 16 of the push-in-station housing 17 and the toothed-belt pulley 18, for coupling the shaft 13 to the drive 22, a cam 25, which is concurrent with the cam 24, is fastened on the shaft 13. The two cams 24 and 25 thus circulate synchronously with the chain wheels 11 and 12 and the toothed-belt pulleys 18 and 19 when the drive motor 22 is switched on and, by way of the toothed-belt pulley 21 seated on its shaft, causes the toothed belt 20 to circulate.

The two cams 24 and 25 are in contact with follower rollers 26 and 27, respectively, which are each mounted in the manner which can be seen from FIGS. 1 and 2, in intermediate regions on links 28 and 29, respectively, the links 28, 29 being fastened, at their outer ends remote from associated pivot bearings 30, on a beam-like roller bar 31 which forms a constituent part of the envelope-conveying arrangement 6.

The links 28 and 29 are angled somewhat in the manner illustrated in the vicinity of the bearing locations for the associated follower rollers 26 and 27, respectively, and extend, through cutouts or slots in parts of the side walls 15 and 16, respectively, of the push-in station housing 17, to the fastening locations on the beam-like roller bar 31. Those regions of the rear ends, as seen in relation to the illustration of FIGS. 1 and 2, of the links 28 and 29 which are in the vicinity of the pivot bearings bear bearing bolts, which are mounted in the abovementioned pivot bearings 30. The geometrical axis of the bearing bolts is depicted by a chain-dotted line 33 in FIGS. 1 and 2 for clarification purposes. Said rear ends of the links 28 and 29, however, are not connected to one another by a physical axis; neither are they mounted directly on the side walls 15 and 16 of the push-in-station housing 17. Instead, they are supported on levers 34 and 35, respectively, via the pivot bearings 30. FIG. 2 indicates only a small part of the lever 35, which is further away from the viewer. The levers 34 and 35 are fastened in a torque-resistant manner on a shaft 36 which, although not shown specifically, is guided by bearings which are supported directly on the push-in-station side walls 15 and 16. The geometrical axis 37 (depicted as a chain-dotted line in FIG. 2) thus has an unchanging position in relation to the push-in-station housing 17. The lever 34 is designed as an angle lever with a leg which is parallel to the lever 35, and is oriented obliquely in the forward direction, and with a vertically upwardly extending leg 38, at the free end of which a retaining magnet or a pressure-medium drive 39 acts. The retaining magnet or drive 39 is supported against a side-wall part of the push-in-station side wall 15. If the drive 39 is switched on, it presses against the free end of the lever leg 38 and pivots the angle lever 34, and thus also the lever 35, in the clockwise direction in relation to the illustration of FIGS. 1 and 2, such that the pivot bearings 30, in their entirety, are also displaced in a clockwise direction and in particular moved downwards.

The downward movement of the pivot bearings 30, and thus of the rear ends of the links 28 and 29, causes the ends of the latter which are connected to the roller bar 31 to be pivoted upwards about the supporting points of the follower rollers 26 and 27 on the cams 24 and 25, respectively, and thus the roller bar 31 to be likewise moved upwards. It is possible for this upward movement of the roller bar 31 to be carried out voluntarily by virtue of the drive 39 being switched on or to be executed once the retaining magnet 39 has been switched off and it, as it were, takes precedence, or is superimposed, over the movement of the roller bar 31 in dependence on the rotation of the cams 24 and 25.

Approximately level with the top side of the conveyor 2 or level with a base plate, over which push-in fingers of the push-in arrangement 4 are guided during the operating stroke, an envelope-filling bench 40 is located in front of the push-in station 3, said bench being provided with through-passages or cutouts through which there is routed an envelope-conveying belt 41 which is positioned over rollers 42 and 43, of which the roller 42 can be driven by means of a drive 44. The envelope-filling bench 40 and the bearings for the rollers 42 and 43 and the support for the drive 44 are located in a framework which is connected to the housing 17 of the push-in station 3. In order to simplify the illustration, and for reasons of clarity, details of this framework have not been shown in the drawing.

A light-barrier arrangement, which is indicated schematically at 46, acts via cutouts or through-passages 45 of the envelope-filling bench 40 and interacts with control apparatuses for the drive 44 for the envelope-conveying belt 41 for the precise positioning of an envelope 5 opposite the push-in station 3. It should also be mentioned that the top strand of the envelope-conveying belt 41 rests essentially on the top surface of the envelope-filling bench 40 and slides over the latter when the envelope-conveying belt 41 is made to circulate by the drive 44.

The roller bar 31 contains a row of comparatively large-diameter rollers 48, which are on the same track relative to the envelope-conveying belt 41. These rollers 48 are spring-mounted individually in each case in relation to the housing of the roller bar 31.

According to an embodiment which is not shown, it is also possible for the roller bar 31 to contain a relatively large number of abutment rolling bodies which are accommodated in an easily movable and rotatable manner in corresponding cages in the housing of the roller bar 31.

If, with the drive 39 for the angle lever 34 switched off, or the retaining magnet 39 for the angle lever 34 switched on, the roller bar 31 has been raised by the links 28 and 29, on account of a corresponding rotary position of the cams 24 and 25, with the result that a relatively large gap is produced between the bottom parts of the rollers 48 and the top strand of the envelope-conveying belt 41, it is possible for an envelope 5 to be pushed into this gap, by suitable feeding means, with its leading border oriented perpendicularly to the envelope opening. If the cams 24 and 25 are then rotated further, during their continuous circulation, the roller bar 31 is lowered and, with the drive 44 for the envelope-transporting belt 41 switched on, the envelope 5, which is initially gripped merely at the leading border, is conveyed further, between the rollers 48 and the envelope transporting belt 41, in the direction of the push-in station into a position opposite the push-in arrangement 4, until the light-barrier arrangement 46 responds and, in conjunction with the control apparatus of the drive 44, positions the envelope 5 correctly in front of the push-in station 3. Once this has taken place, then, during the continuous rotation of the cams 24 and 25, regions of said cams pass beneath the follower rollers 26 and 27, which cause the roller bar 31 to be raised again by way of the links 28 and 29. The positioned envelope 5 may then be opened by suitable arrangements, for example those known to the person skilled in the art, with the result that the push-in arrangement 4 can push into the open envelope 5 an enclosure or a set of enclosures which has been conveyed up by the conveyor 2. On account of the cams 24 and 25 proceeding further, the roller bar 31 is then lowered again and the drive 44 for the envelope-transporting belt 41 is switched on again, with the result that the filled envelope 5 is conveyed away, in order then to be closed, while a new envelope 5 is conveyed in front of the push-in arrangement 4 in the manner which has just been described.

Looking at FIG. 1 again, it can be seen that the toothed belt 50 positioned around the toothed-belt pulley 19 is routed upwards and is positioned about a belt pulley 51 which is coupled to a further belt pulley, from which, in turn, via a toothed belt 53, an elliptical belt pulley 54 is driven, the latter, for its part, driving a crank shaft mounted in the push-in-station housing 17. The crank shaft actuates, via a connecting rod, a pivot-lever arrangement which forms a constituent part of the push-in arrangement 4 and is retained on bearings within the push-in-station housing 17. The elliptical shape of the toothed-belt pulley 54 is selected in order to give the push-in arrangement 4 certain movement characteristics relative to the movement of the conveying fingers 8 of the conveyor 2.

The phase position of the periodic up and down movements of the roller bar 31 on account of the circulation of the cams 24 and 25 relative to the phase position of the periodic delivery of the enclosures or sets of enclosures and relative to the phase position of the periodic movements of the push-in arrangement 4 can be adjusted in that the cams 24 and 25 are fastened on the shaft 13 such that they can be adjusted in terms of their rotary position.

From FIGS. 1 and 2 in conjunction with the above description of the functioning of the hitherto-described parts of the system, it can be seen that the roller bar 31 and the links 28 and 29 behave in the manner of a rigid frame which, in its central region, is supported in a stable manner by the follower rollers 26 and 27 on both sides of the push-in station 3, because the rear parts of the frame, in the region of the pivot bearing 30, are supported in a stable manner by the levers 34 and 35, which are connected in a torque-resistant manner via the shaft 36 and, with the drive 39 non-operational or the retaining magnet 39 switched on, are retained in a fixed pivot position. The links 28 and 29, the levers 34 and 35 and the shaft 36 do not displace the through-passage space located above the conveying path of the conveyor 2 in the push-in-station-housing 17, the shaft 36 in particular being routed through, beneath the top strand of the conveying chains 9 and 10, between the top strand and the bottom strand.

If during regular operation, with control of the raised position or of the lowered position of the roller bar 31 in relation to the envelope-conveying belt 41 on account of the continuous circulation of the cams 24 and 25, a build-up of envelopes should occur in the envelope-conveying arrangement 6, the drive 39 is actuated and the levers 34 and 35 are pivoted in a clockwise direction, with the result that the roller bar 31 can be raised a considerable way off from the transporting belt 41 and the build-up of envelopes can be removed without the operational setting of the system otherwise being changed or disrupted. Once the build-up has been removed, the drive 39 is withdrawn again, the levers 34 and 35 are moved in the anticlockwise direction and the roller bar 31 is lowered into precisely that position which it had previously occupied on account of a certain rotary position of the cams 24 and 25.

Figure 3:
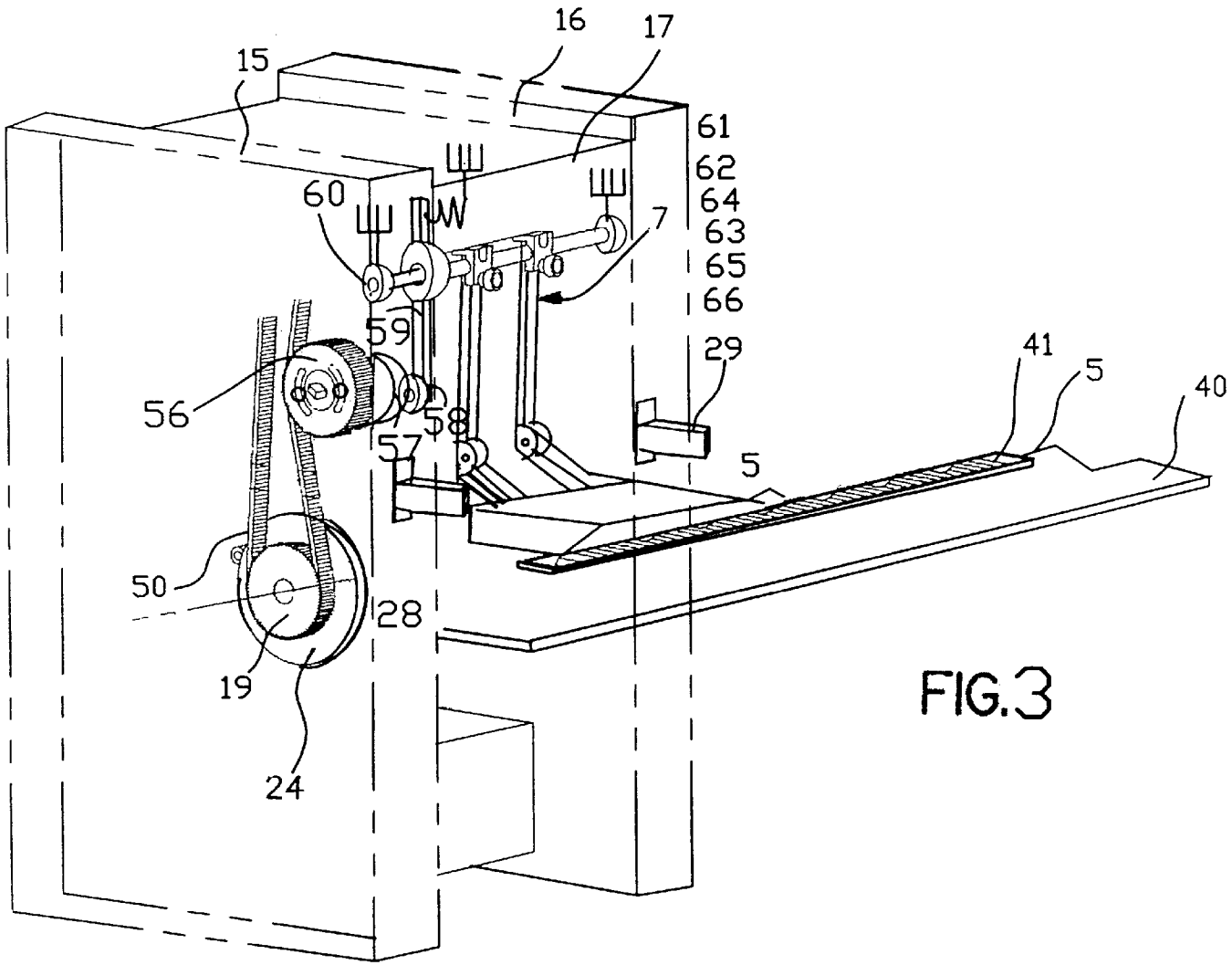
FIG. 3 shows a perspective view of that part of the drive and actuating system which relates to an auxiliary push-in arrangement of the envelope-filling station according to FIG. 1.

The belt pulley 19, which is fastened alongside the cam 24 on the drive shaft 13 for the chain wheels 11 and 12, not only serves for driving the push-in arrangement 4 via the toothed belt 50, the belt pulley 51, the toothed belt 53 and the elliptical belt pulley 54, but also, likewise via the toothed belt 50, causes the auxiliary push-in arrangement 7 to be actuated, as can be seen from FIG. 3. For this purpose, the toothed belt 50 is routed past a toothed-belt pulley 56 which is fastened such that it can be adjusted in terms of its rotary position on a shaft mounted on the push-in-housing side wall 15, as is indicated in the drawing by fastening through-passages of arc-sector form in the belt pulley 56. Fastened on the shaft bearing the belt pulley 56, on the inside of the push-in-housing side wall 15, is a cam 57 which is in contact with a follower roller 58 which is located at one end of a cam follower lever 59. The cam follower lever 59 is fastened on a pivot shaft 62, which is mounted on the push-in-housing side walls 15 and 16 by bearings 60 and 61. The pivot shaft 62 bears two pivot arms 63 and 64, auxiliary push-in fingers 65 and 66, respectively, being connected to the bottom ends thereof.

With a rotation of the drive shaft 13 for the chain wheels 11 and 12, and thus also the toothed-belt pulley 19, the toothed-belt pulley 56 is also caused to revolve via the toothed belt 50, with the result that the cam 57 executes corresponding rotations. This rotation of the cam 57 results in pivot movements of the cam follower lever 59 and thus in corresponding pivot movements of the pivot levers 63 and 64, with the result that the auxiliary push-in fingers 65 and 66 move into the opening of an envelope 5 which has been conveyed over by the envelope-conveying arrangement 6, and is held ready in an open state, and hold the opening open until the push-in arrangement 4 has pushed an insert or a set of inserts, beneath the auxiliary push-in fingers 65 and 66, into the envelope 5, whereupon the auxiliary push-in fingers 65 and 66 and the pivot levers 63 and 64, with corresponding continued rotation of the cam 57, are guided back under spring force into a starting position.

What is claimed is:

1. A drive and actuating system for an envelope-filling station in which enclosures or sets of enclosures are fed, by means of a continuously driven conveyor, to a push-in station in which a push-in arrangement, which has a pivot drive, receives the enclosures or sets of enclosures and pushes them into envelopes, which are held ready in an open state, in a direction which corresponds to the conveying direction of the conveyor, wherein the envelopes are delivered into a position opposite the push-in station, from a direction oriented transversely to the push-in direction, by means of an envelope-conveying arrangement which contains an envelope-conveying belt, which is oriented transversely to the push-in direction, and an abutment arrangement, which can be lowered thereon, and raised therefrom, in a controlled manner, and position-detector means which are provided along the path of the envelope-conveying belt, wherein the abutment arrangement is fastened at the front ends of the two links which are supported such that they can be pivoted in relation to the side walls of a housing of the push-in station and each bear, in corresponding regions between their pivot bearing and the location at which they are fastened on the abutment arrangement, cam follower rollers which each butt against cams which are seated on a shaft with a driven roller or driven chain wheels of the conveyor, such that the abutment arrangement is moved up and down synchronously with the feed of the enclosures or sets of enclosures by means of the conveyor by way of a common drive motor.

2. A drive and actuating system according to claim 1, wherein the pivot bearings of the links are supported relative to the side walls of the housing of the push-in station on levers which, on the one hand, are connected pivotably to the respective side wall and, on the other hand, each bear the pivot bearing for an associated link, wherein the pivot position of the levers can be adjusted in selectable manner by means of at least one drive in order to effect voluntary raising or lowering of the abutment arrangement, irrespective of the position of the cam follower rollers.

3. A drive and actuating system according to claim 2, wherein the levers are fastened on a shaft which is routed through beneath the top strand of the chains or of the belt of the conveyor.

4. A drive and actuating system according to claim 1, wherein from a toothed-belt pulley which is likewise seated on the shaft, which bears the driven roller or the driven chain wheels, on one side of a side wall of the push-in station, a toothed-belt drive is routed to a toothed-belt pulley, in particular an elliptical tooth-belt pulley, for the pivot drive of the push-in arrangement.

5. A drive and actuating system according to claim 1, wherein from the toothed-belt pulley which is likewise seated on the shaft, which bears the driven roller or the driven chain wheels, on one side of a side wall of the push-in station, a toothed-belt drive is routed to a further toothed-belt pulley which serves for driving a cam against which there butts a follower roller which is mounted at the free end of a pivot lever for rotating a shaft which, for its part, bears pivot arms of an auxiliary push-in arrangement.

6. A drive and actuating system according to claim 5, wherein a coupling which can be released and secured again for adjustment purposes is provided between the further toothed-belt pulley and the cam driven by it.

7. A drive and actuating system according to claim 1, wherein the abutment arrangement is formed by a roller bar which contains large-diameter spring-mounted rollers which are located opposite the envelope-conveying belt, on the same track, the roller bar having an approximately beam-like housing which spans the outlet of the push-in station and on which the links are fastened.

8. A drive and actuating system according to claim 2, wherein the levers being fastened in a torque-resistant manner on a shaft which is guided by bearings which are supported directly on the side walls of the push-in station.

* * * * *